US011313266B2

(12) United States Patent
Tucker et al.

(10) Patent No.: US 11,313,266 B2
(45) Date of Patent: Apr. 26, 2022

(54) COMPACT MIXER WITH FLOW DIVERTER

(71) Applicant: Faurecia Emissions Control Technologies, USA, LLC, Columbus, IN (US)

(72) Inventors: Alfred N. Tucker, Columbus, IN (US); Tomasz Kozakeiwicz, Columbus, IN (US); Syed Saleem Quadri, Columbus, IN (US); Jeffery Prairie, Franklin, IN (US)

(73) Assignee: Faurecia Emissions Control Technologies, USA, LLC, Columbus, IN (US)

( * ) Notice: Subject to any disclaimer, the term of this patent is extended or adjusted under 35 U.S.C. 154(b) by 0 days.

(21) Appl. No.: 16/629,065

(22) PCT Filed: Sep. 1, 2017

(86) PCT No.: PCT/US2017/049805

§ 371 (c)(1),
(2) Date: Jan. 7, 2020

(87) PCT Pub. No.: WO2019/045748

PCT Pub. Date: Mar. 7, 2019

(65) Prior Publication Data

US 2020/0131969 A1 Apr. 30, 2020

(51) Int. Cl.

| | |
|---|---|
| ***F01N 3/28*** | (2006.01) |
| ***F01N 3/08*** | (2006.01) |
| ***F01N 3/20*** | (2006.01) |
| ***B01F 23/213*** | (2022.01) |
| ***B01F 25/313*** | (2022.01) |

(52) U.S. Cl.
CPC ..... *F01N 3/2892* (2013.01); *B01F 23/2132* (2022.01); *B01F 25/3131* (2022.01);
(Continued)

(58) Field of Classification Search
CPC .... F01N 3/2892; F01N 3/2066; F01N 3/0807; F01N 3/021; F01N 3/103;
(Continued)

(56) References Cited

U.S. PATENT DOCUMENTS 9,828,897 B2 * 11/2017 Alano ..... B01D 53/9431
10,337,380 B2 * 7/2019 Willats ..... F01N 3/035
(Continued)

FOREIGN PATENT DOCUMENTS

CN 106414931 A 2/2017
JP 5132187 B2 1/2013
(Continued)

OTHER PUBLICATIONS

International Search Report dated Jan. 29, 2018.
International Preliminary Report on Patentability for PCT Application No. PCT/US2017/049805 dated Mar. 12, 2020.

*Primary Examiner* — Devon C Kramer
*Assistant Examiner* — Kelsey L Stanek
(74) *Attorney, Agent, or Firm* — Carlson, Gaskey & Olds, P.C.

(57) ABSTRACT

A mixer assembly for a vehicle exhaust system includes an inner wall surface and a flow diverter with a flow directing surface that is spaced apart from the inner wall surface to provide an exhaust gas inlet area. The flow directing surface terminates at a distal end that is spaced apart from the inner wall surface to provide an orifice between the distal end and the inner wall surface through which exhaust gas flow accelerates and is directed to flow along the inner wall surface. A vehicle exhaust component assembly that includes the mixer and a method for mixing injected fluid spray into the mixer are also disclosed.

25 Claims, 3 Drawing Sheets

(52) U.S. Cl.
CPC ..... *F01N 3/0807* (2013.01); *F01N 3/2066* (2013.01); *F01N 2610/1453* (2013.01)

(58) Field of Classification Search
CPC ..... F01N 2610/1453; F01N 2610/02; F01N 13/009; F01N 13/0097; F01N 2570/18; B01F 3/04049; B01F 5/0451; B01F 5/045; B01F 5/0473; B01F 5/0608; B01F 2005/0091; Y02A 50/20; Y02T 10/12
USPC ..... 60/273
See application file for complete search history.

(56) References Cited

U.S. PATENT DOCUMENTS

| | | | | |
|---|---|---|---|---|
| 10,933,387 | B2 * | 3/2021 | Cvelbar | F01N 3/2892 |
| 2012/0144812 | A1 * | 6/2012 | Hyun | F01N 3/2892 60/301 |
| 2015/0240689 | A1 * | 8/2015 | Guilbaud | F01N 13/10 60/295 |
| 2016/0131007 | A1 * | 5/2016 | Kauderer | F01N 13/0097 422/177 |
| 2016/0215673 | A1 * | 7/2016 | Noren, IV | B01F 5/0057 |
| 2016/0319724 | A1 * | 11/2016 | Alano | B01F 5/0614 |
| 2017/0082007 | A1 * | 3/2017 | Alano | F01N 3/2066 |

FOREIGN PATENT DOCUMENTS

| | | | |
|---|---|---|---|
| KR | 101461325 | B1 | 11/2014 |
| KR | 101526374 | B1 | 6/2015 |

* cited by examiner

COMPACT MIXER WITH FLOW DIVERTER

BACKGROUND OF THE INVENTION

An exhaust system conducts hot exhaust gases generated by an engine through various exhaust components to reduce emissions and control noise. The exhaust system includes an injection system that injects a diesel exhaust fluid (DEF), or a reducing agent such as a solution of urea and water for example, upstream of a selective catalytic reduction (SCR) catalyst. A mixer is positioned upstream of the SCR catalyst and mixes engine exhaust gases and products of urea transformation. The injection system includes a doser that sprays the urea into the exhaust stream. The urea should be transformed as much as possible into ammonia ($NH_3$) before reaching the SCR catalyst. Thus, the droplet spray size plays an important role in reaching this goal.

The industry is moving towards providing more compact exhaust systems, which results in reduced volume of the system. Systems that spray larger size droplets may not be able to provide adequate transformation of urea when used in more compact system configurations. As such, smaller droplet size dosers are required for these more compact configurations.

The smaller the droplet size, the more effective the transformation into ammonia is, due to the increased surface contact area. However, the spray generated by small droplet dosers is very sensitive to recirculation flow. Typically, an area located at a tip of the doser has a vortex of recirculating flow. This vortex pushes the spray droplets towards the walls of the mixing area at the injection site, which creates deposit initiation sites along the walls. The deposits build up over time and can adversely affect system operation. For example, there may be a lower ammonia uniformity index, there may be an increased pressure drop across the mixer, or higher ammonia emissions during active diesel particulate filter (DPF) regeneration.

SUMMARY OF THE INVENTION

In one exemplary embodiment, a mixer assembly for vehicle exhaust system includes an inner wall surface and a flow diverter with a flow directing surface that is spaced apart from the inner wall surface to provide an exhaust gas inlet area. The flow directing surface terminates at a distal end that is spaced apart from the inner wall surface to provide an orifice between the distal end and the inner wall surface through which exhaust gas flow accelerates and is directed to flow along the inner wall surface.

In a further embodiment of the above, the flow directing surface includes a first wall portion that extends outwardly from the inner wall surface and a second wall portion that extends transversely from the first wall portion to terminate at the distal end which is spaced apart from the inner wall surface by a gap to provide the orifice.

In a further embodiment of any of the above, the assembly includes an inlet baffle with at least one inlet opening that directs exhaust gas flow into the exhaust gas inlet area between the inner wall surface and the flow directing surface.

In a further embodiment of any of the above, the assembly includes a cone having a cone inlet that receives injected fluid spray to mix with exhaust gas flow exiting the orifice, and wherein the exhaust gas inlet area is free from injected spray.

In another exemplary embodiment, a vehicle exhaust component assembly comprises a mixer housing that defines an internal cavity and surrounds a mixer center axis, and which includes an inner wall surface. An inlet baffle is supported by an upstream end of the mixer housing and includes a plurality of inlet openings. An outlet baffle is supported by a downstream end of the mixer housing and includes at least one outlet opening. An injection cone is positioned between the inlet and outlet baffles, and the injection cone has a cone inlet configured to receive injected fluid spray and a cone outlet to direct a mixture of injected fluid spray and exhaust gas into the internal cavity. A flow diverter includes a flow directing surface that is spaced apart from the inner wall surface to provide an exhaust gas inlet area that receives exhaust gas from at least one of the inlet openings and which is free from injected fluid spray. The flow directing surface terminates at a distal end that is spaced apart from the inner wall surface to provide an orifice between the distal end and the inner wall surface that accelerates exhaust gas flow through the orifice and directs the exhaust gas flow to flow along the inner wall surface to mix with the mixture of injected fluid spray and exhaust gas exiting the cone outlet.

In a further embodiment of any of the above, the mixer housing comprises an outer wall that extends completely around the mixer center axis and an inner wall that is spaced radially inward of the outer wall and extends at least partially about the mixer center axis, and wherein the inner wall provides the inner wall surface that faces the mixer center axis.

In a further embodiment of any of the above, the plurality of inlet openings includes at least a first inlet opening that directs a first portion of exhaust gas into the exhaust gas inlet area, a second opening that directs a second portion of exhaust gas toward the cone inlet, and a plurality of third openings that direct a remaining portion of the exhaust gas into the internal cavity, and wherein the first portion is greater than the second portion.

In a further embodiment of any of the above, the flow directing surface includes a first wall portion that extends outwardly from the inner wall surface and a second wall portion that extends transversely from the first wall portion to terminate at the distal end which is spaced apart from the inner wall surface by a gap to define the orifice.

In a further embodiment of any of the above, the first and second wall portions cooperate to turn exhaust gas flow entering the exhaust gas inlet area at least ninety degrees prior to exiting the orifice.

In another exemplary embodiment, a method for injecting a fluid into an exhaust component includes the steps of: providing a housing with an internal cavity having an inner wall surface; positioning an injection cone in the internal cavity; injecting fluid spray into a cone inlet of the injection cone to mix with exhaust gas prior to exiting a cone outlet; spacing a flow diverter with a flow directing surface apart from the inner wall surface to provide an exhaust gas inlet area; positioning the flow directing surface to terminate at a distal end that is spaced apart from the inner wall surface to provide an orifice between the distal end and the inner wall surface; and accelerating exhaust gas flow through the orifice and directing the exhaust gas flow to flow along the inner wall surface to mix with injected fluid spray and exhaust gas exiting the cone outlet.

In a further embodiment of any of the above, the method includes using the flow diverter to turn exhaust gas flow entering the exhaust gas inlet area at least ninety degrees prior to exiting the orifice.

These and other features of this application will be best understood from the following specification and drawings, the following of which is a brief description.

DETAILED DESCRIPTION

Figure 1:
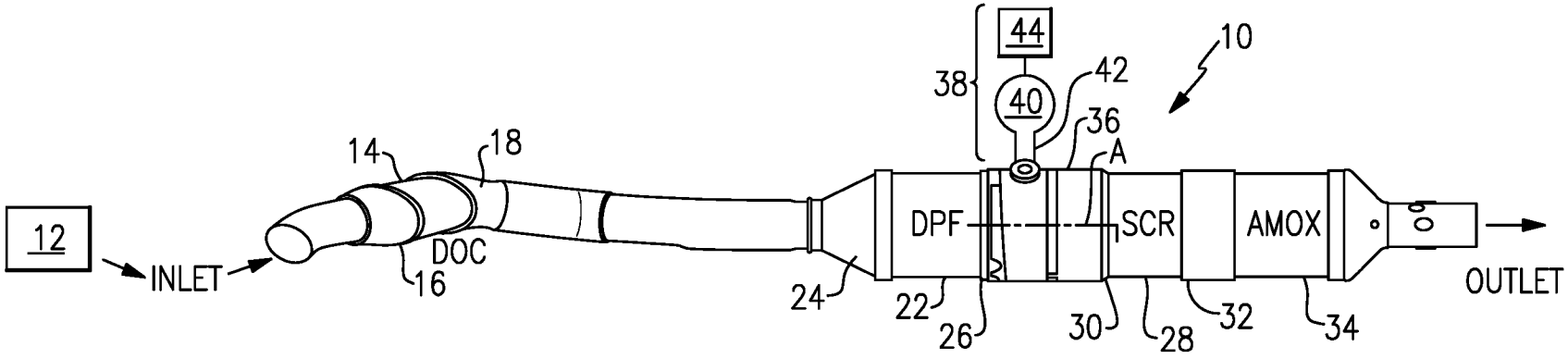
FIG. 1 schematically illustrates one example of an exhaust system with a mixer according to the subject invention.

FIG. 1 shows a vehicle exhaust system 10 that conducts hot exhaust gases generated by an engine 12 through various exhaust components to reduce emission and control noise as known. The various exhaust components can include one or more of the following: pipes, filters, valves, catalysts, mufflers etc. After passing though the various exhaust components, the engine exhaust gas exits the system 10 to atmosphere as known. As known, the vehicle exhaust components must be made from materials that can withstand high temperatures and corrosive operating conditions.

In one example configuration shown in FIG. 1, the exhaust components direct engine exhaust gases into a diesel oxidation catalyst (DOC) 14 having an inlet 16 and an outlet 18. Downstream of the DOC 14 there may be a diesel particulate filter (DPF) 22 that is used to remove contaminants from the exhaust gas as known. The DPF has an inlet 24 and an outlet 26. Downstream of the DOC 14 and optional DPF 22 is a selective catalytic reduction (SCR) catalyst 28 having an inlet 30 and an outlet 32. The outlet 32 communicates exhaust gases to downstream exhaust components 34, such as an ammonia oxidation catalyst (AMOX) for example. Optionally, component 28 can comprise a catalyst that is configured to perform a selective catalytic reduction function and a particulate filter function. Other downstream exhaust components 34 can include one or more of the following: pipes, additional filters, valves, additional catalysts, mufflers etc. These exhaust components can be mounted in various different configurations and combinations dependent upon vehicle application and available packaging space.

A mixer 36 is positioned upstream of the inlet 30 of the SCR catalyst 28 and downstream from the outlet 18 of the DOC 14, or the outlet 26 of the DPF 22. The upstream catalyst and downstream catalyst can be arranged to be in-line, parallel, or angled relative to each other. The mixer 36 is used to generate a swirling or rotary motion of the exhaust gas. This will be discussed in greater detail below.

An injection system 38 is used to inject a fluid such as DEF or a reducing agent, such as a solution of urea and water for example, into the exhaust gas stream upstream from the SCR catalyst 28 such that the mixer 36 can mix the fluid and exhaust gas thoroughly together. The injection system 38 includes a fluid supply 40, a doser or injector 42, and a controller 44 that controls injection of the fluid as known.

Figure 2:
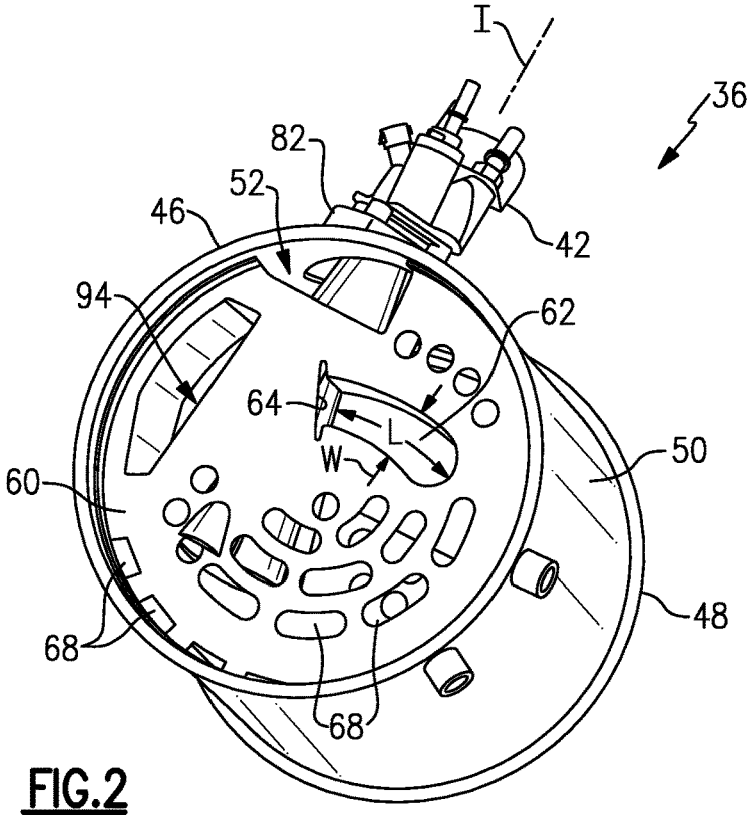
FIG. 2 is a perspective view of an upstream end of one example of a mixer with an injection assembly that includes the subject invention.
Figure 7:
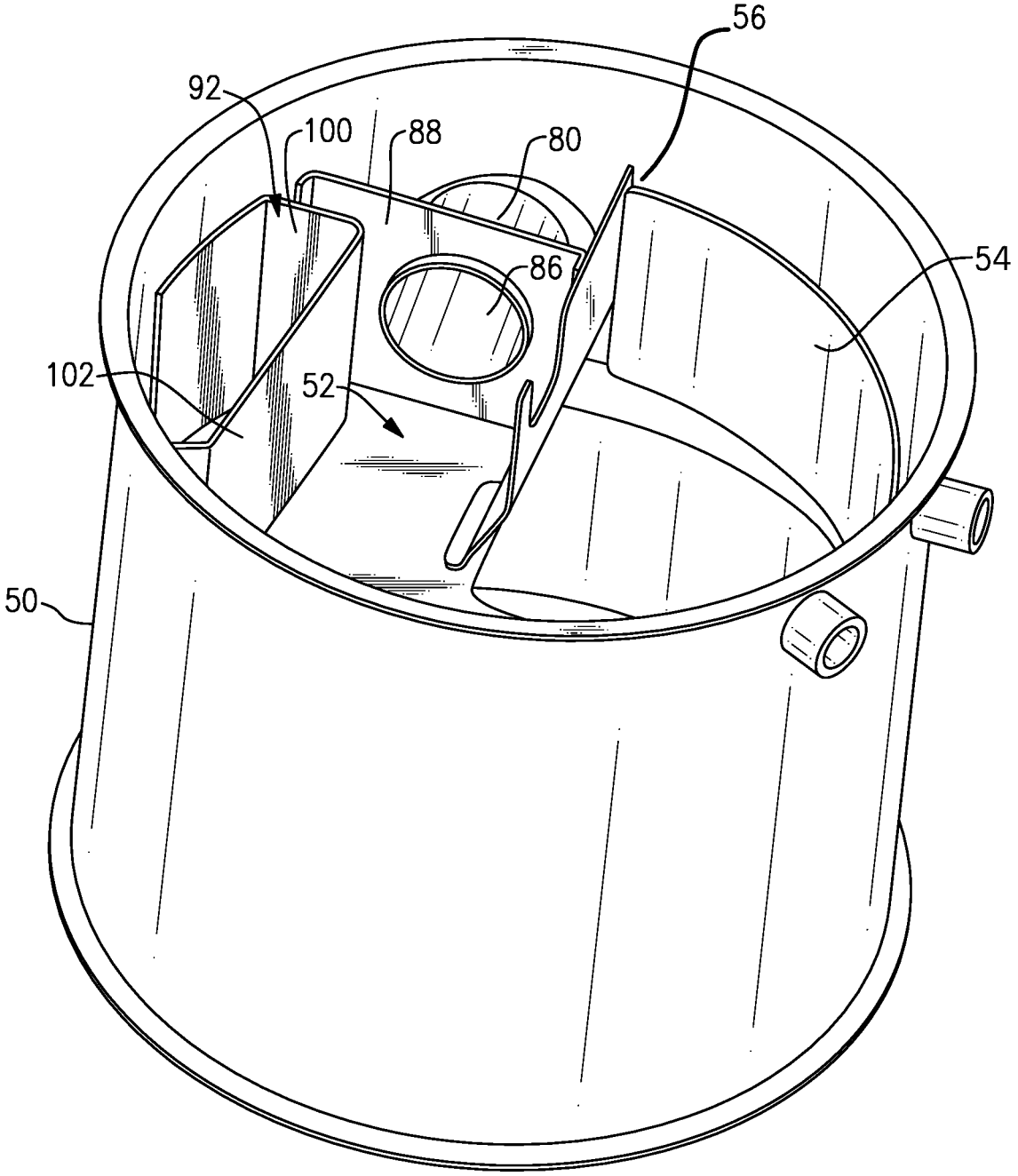
FIG. 7 is a view similar to FIG. 2 but without the inlet baffle.

As shown in FIG. 2, the mixer 36 comprises a mixer body having an upstream or inlet end 46 configured to receive the engine exhaust gases and a downstream or outlet end 48 to direct a mixture of swirling engine exhaust gas and products transformed from urea to the SCR catalyst 28. The mixer 36 defines a mixer center axis A (FIG. 1) and includes an outer housing 50 comprising an outer wall that defines an internal cavity 52 (FIGS. 2 and 7) that provides an engine exhaust gas flow path from the inlet end 46 to the outlet end 48. The mixer 36 includes an inner wall 54 (FIG. 3) that is spaced radially inward from the outer housing 50 by an insulation gap 56. The inner wall 54 extends at least partially around the mixer center axis A. In one example, the inner wall 54 does not extend completely around the mixer center axis A.

Figure 4:
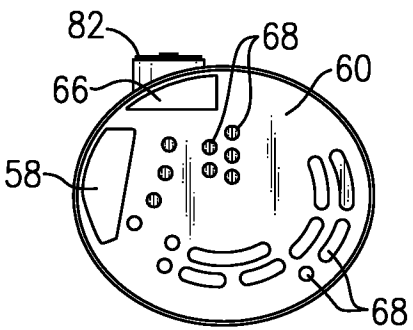
FIG. 4 is an end view of one example of an inlet baffle that can be used with the mixer of FIG. 2.

The mixer 36 includes an inlet baffle 60 supported by the outer housing 50 and/or the inner wall 54 adjacent to the inlet end 46. In one example, the inlet baffle 60 includes at least one elongated scoop 62 that is used to direct engine exhaust gas through a scoop opening 64 and into the internal cavity 52 to mix with spray injected by the injector 42. The scoop 62 comprises a recessed area formed within the inlet baffle 60 to scoop or direct exhaust gas flow in a desired direction into the internal cavity 52 to improve performance and to minimize deposit formation on inner wall surfaces. The number of scoops can vary; however, the number of scoops is preferably no more than four. In another example, the inlet baffle 60 may not include any scoops (see FIG. 4).

In one example configuration, the scoop 62 is elongated and has a scoop length L that is greater than a scoop width W. In one example, the inlet baffle 60 comprises a flat plate having an upstream surface and a downstream surface that faces the internal cavity 52 with the scoop 62 comprising an inwardly extending recessed area formed in the flat plate. The inlet baffle 60 includes at least a first opening 58, a second opening 66 and a plurality of additional openings 68. The first 58 and second 66 openings comprise primary openings through which a majority of the exhaust gas flows, while the additional openings 68 comprise secondary openings that are smaller than the primary openings. The secondary openings help reduce back pressure and can be configured to have different shapes, sizes, and/or patterns in various combinations.

Figure 5:
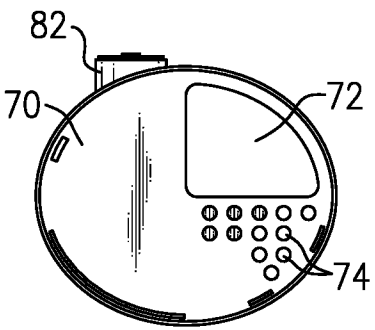
FIG. 5 is an end view of the outlet baffle of the mixer of FIG. 2.

The mixer 36 also includes an outlet baffle 70 (FIG. 5) through which a mixture of spray and exhaust gas exits the outlet end 48. The outlet baffle 70 comprises a flat plate that includes at least one primary opening 72 through which a majority of a mixture of engine exhaust gas and spray exits the internal cavity 52 and a plurality of secondary openings 74 that are smaller than the primary opening 72. The secondary openings 74 help reduce back pressure and can be configured to have different shapes, sizes, and/or patterns in various combinations. Note that while flat plates are shown in the disclosed examples for the inlet 60 and outlet 70 baffles, it should be understood that a contoured or helical plate configuration could also be used. However, the flat plate configuration is preferred as it provides improved performance and is easier to manufacture.

The first opening 58 is positioned at a peripheral edge of the inlet baffle 60 and extends circumferentially along the edge for a desired distance to provide a sufficient size opening to direct a desired amount of exhaust gas into an exhaust gas inlet area 94. The second opening 66 is positioned at a peripheral edge of the inlet baffle 60 and is circumferentially spaced apart from the first opening 58. The second opening 66 is positioned near the injector 42 to direct exhaust gas toward a cone inlet through which the spray is injected into the mixer 36. This will be discussed in greater detail below.

Figure 3:
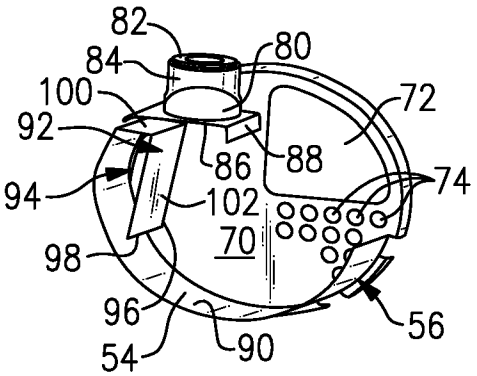
FIG. 3 is a perspective view of an outlet baffle, inner wall, injection cone, and flow diverter of the mixer of FIG. 2.

As shown in FIG. 3, the mixer 36 includes an injection or swirl cone 80 that surrounds spray injected by the injector 42. The injector 42 defines an injection axis I (FIG. 2) that extends transversely to the mixer center axis A (FIG. 1). A base end of the cone 80 is positioned adjacent an injector mount 82 that is supported by the housing 50 near the injector 42 such that an annular gap is formed at the base end of the cone 80. An outer housing 84 at least partially surrounds the injector cone 80. Exhaust gas is directed to enter the base end of the cone 80 through the annular gap in a direction transverse to the injection axis I. The exhaust gas mixes with the injected fluid spray in the cone 80. The second opening 66 of the inlet baffle 60 is positioned adjacent the injector 42 and overlaps the cone 80 such that exhaust gas is directed toward the inlet area of the cone 80 at the base end. In one example, the second opening 66 forms a cut-out area in the outer peripheral edge of the inlet baffle 60. The injector cone 80 extends from the inlet or base end to an outlet end 86 through which a mixture of exhaust gas and fluid spray exits.

As shown in FIG. 3, the inner wall 54 includes an inner wall surface 90 that is associated with a flow diverter 92 that includes a flow directing surface spaced apart from the inner wall surface 90 to provide an exhaust gas inlet area 94. The flow directing surface terminates at a distal end 96 that is spaced apart from the inner wall surface 90 to provide an orifice 98 between the distal end 96 and the inner wall surface 90 through which exhaust gas flow accelerates and is directed to flow along the inner wall surface 90.

The flow directing surface of the flow diverter 92 includes a first wall portion 100 that extends outwardly from the inner wall surface 90 and a second wall portion 102 that extends transversely from the first wall portion 100 to terminate at the distal end 96 which is spaced apart from the inner wall surface 90 by a gap to provide the orifice 98. The first 100 and second 102 wall portions cooperate to define the exhaust gas inlet area 94. The first inlet opening 58 directs exhaust gas flow into the exhaust gas inlet area 94 between the inner wall surface 90 and the flow directing surface. In one example, the first inlet opening 58 is positioned on the inlet baffle 60 to directly overlap the exhaust gas inlet area 94. In one example, the first inlet opening 58 is generally the same size and shape as the exhaust gas inlet area 94.

In the example shown, the wall portions 100, 102 comprise straight walls; however, either or both walls 100, 102 could comprise curved surfaces. In one example, the flow diverter 92 is mounted to at least one of the outer housing 50, inlet baffle 60, outlet baffle 70, and inner wall 54. Optionally, the flow diverter 92 could be integrally formed with the inner wall 54. The inner wall 54 and/or the flow diverter 92 can be stamped, cast or formed using any know manufacturing method. In one example, the inner wall 54 has a first end attached to a bracket 88 that supports the cone 80, and extends to a second end that terminates near an edge of the primary opening 72 in the outlet baffle 70.

Figure 6:
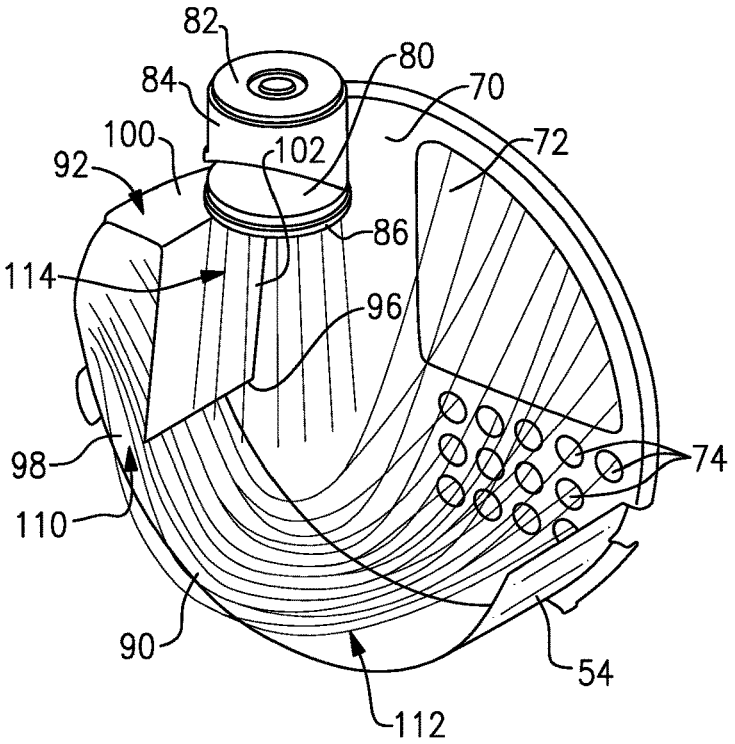
FIG. 6 is a perspective view similar to FIG. 3 but showing flow streamlines

As discussed above, the cone 80 has a cone inlet that receives injected fluid spray to mix with exhaust gas flow that enters the inlet end of the cone via the second opening 66. The mixture of spray and exhaust gas then exits the cone outlet 86 to mix with the exhaust gas exiting the orifice 98. The exhaust gas inlet area 94 receives exhaust gas flow from the first opening 58 and is free from injected spray. The first 100 and second 102 wall portions cooperate to turn the exhaust gas flow entering the exhaust gas inlet area 94 at least ninety degrees prior to exiting the orifice 98. Thus, the flow diverter 92 is used to direct flow toward a surface most likely to be impacted by spray, i.e. the surface opposite of the cone outlet 86 (see FIG. 6). As shown with the exhaust gas streamlines depicted in FIG. 6, exhaust flow entering the exhaust gas inlet area 94 is turned and directed to accelerate through the orifice 98 as indicated at 110 and sweep along the inner wall surface 90 as indicated at 112 before the flow is mixed with fluid spray exiting the cone 80 as indicated at 114.

Mixing of exhaust gas and spray inside the internal cavity 52 is created by the shape, size, and location of the additional openings 68, 74 in the inlet 60 and outlet 70 baffles. As discussed above, both the inlet 60 and outlet 70 baffles are relatively flat plates; however, the plates can be angled such that the flow velocity is maintained while, and until, mixing occurs. Back pressure is relieved by slots/holes 74 around a perimeter of the outlet baffle 70 and slots/holes 68 of the inlet baffle 60.

In one example, the first opening 58 overlaps the inlet exhaust gas area 94 and receives a first percentage of the exhaust gas flow and the second opening 66 receives a second percentage of the exhaust gas flow that is less than the first percentage. In one example, approximately 5-10% of the flow enters the second opening 66 while approximately 50% or more of the flow enters the first opening 58. Any remaining flow enters the cavity via the scoop 62 and/or the additional slots and/or openings 68.

The inner wall 54 has the highest potential concentration of spray impingement inside the mixer 36. The subject invention utilizes a flow diverter 92 to direct exhaust flow through the inlet baffle 60 into the exhaust gas inlet area 94 between the inner wall 54 and the flow diverter 92, and then turn the flow 90 degrees to eject the flow into an accelerated sweeping flow exiting the orifice 98 and extending across the remaining length of the inner wall 54. The sweeping flow is directed over the spray impact area of the inner wall 54 with enough velocity and volume to transfer heat into the wall 54 to cause thermolysis and hydrolysis of the spray fluid and to create a mixing effect that mixes exhaust with the spray fluid and NH3 inside of the mixer 36. Exhaust gas is not mixed with the reducing agent fluid until the flow exits the exhaust gas inlet area 94 created by the flow diverter 92 spaced relative to the inner wall 54. The flow diverter 92 is positioned within the internal cavity 52 to create the orifice 98 as a pinch point between the inner and outer walls that serves to accelerate the exhaust gas and direct it into a sweeping flow that grazes over the length of the inner wall 54. This configuration evenly distributes the flow with high velocity over the entire area of the impingement surface. This provide a significant improvement over using scoops alone.

In one preferred example, the inlet baffle 60 includes at least one scoop 62 that is placed upstream of the injection and which is used to redirect the flow to improve mixing of the exhaust gas with the injected spray. The scoop 62 can be positioned anywhere upstream at any angle (parallel to the injection spray or at an angle to the spray) and perpendicular or at an angle to the exhaust gas stream. The scoop 62 is designed to increase the heat transfer on the surfaces that the spray impinges to reduce deposits or prevent deposits from forming. The scoop 62 interacts with the flow from the flow diverter 92 resulting in higher heat transfer for deposit mitigation and improvement of NH3 uniformity index. More scoops can be added as needed.

The scoops can be stamped, cast, welded or formed on a flat, curved or angled plate or a helix plate. The scoops can be upstream of the spray injection area, parallel or at an angle to the spray injection, and/or perpendicular or at an angle to the exhaust flow. The scoops can be curved, straight, or tapered as required to direct and modify the flow inside the mixer for deposit prevention and internal mixing. The scoop depth can be varied using the bottom angle to increase, decrease, or keep constant the cross-sectional area in a direction from the front of the scoop to the rear of the scoop to direct and modify flow inside the mixer as required for deposit prevention, internal mixing, and back pressure relief. Scoop length can be varied to regulate mass flow as required to prevent deposit formation, improve mixing, and provide back pressure relief.

Additional openings and/or slots are formed on the inlet plate to allow the flow underneath the impingement surface to improve the heat transfer, flow uniformity index, and reduce back pressure. The additional openings 68 in the inlet baffle can comprise circular and/or elliptical holes that optimized to improve flow, NH3 uniformity index, and prevent or reduce deposits.

The outlet baffle 70 is spaced axially from the inlet baffle 60 such that spray is injected between the two flat, curved or angled plates that form the baffles 60, 70. The plates are positioned to improve mixing of exhaust gas and reducing agent and to reduce deposits or prevent deposits from forming. The outlet baffle 70 is positioned to improve the NH3 uniformity index and flow uniformity index on the catalyst or other downstream components. The additional openings on the outlet baffle can comprise slots that allow the flow from the baffle to exit underneath the impingement surface to improve the heat transfer, flow and reduce back pressure. The additional openings 74 in the outlet baffle can comprise circular and/or elliptical holes that optimized to improve flow, NH3 uniformity index and prevent or reduce deposits.

Although an embodiment of this invention has been disclosed, a worker of ordinary skill in this art would recognize that certain modifications would come within the scope of this invention. For that reason, the following claims should be studied to determine the true scope and content of this invention.

The invention claimed is:

1. A mixer assembly for an exhaust system comprising:

an outer housing defining a mixer center axis and providing an internal cavity that receives engine exhaust gases;

an inner wall positioned within the internal cavity and spaced radially inward of the outer housing by a first gap;

an injection member having an injection inlet configured to receive injected fluid spray and an injection outlet to direct a mixture of injected fluid spray and exhaust gas into the internal cavity; and a flow diverter including a flow directing surface spaced radially inward from the inner wall to provide an exhaust gas inlet area, wherein the inner wall defines an inner wall surface that faces the flow directing surface and an outer wall surface that faces the first gap, and wherein the flow directing surface terminates at a distal end that is spaced apart from the inner wall surface to provide an orifice between the distal end and the inner wall surface through which exhaust gas flow accelerates and is directed to flow along the inner wall surface, and wherein flow exiting the orifice is directed toward a surface opposite of the injection outlet.

2. The mixer assembly according to claim 1, wherein the flow directing surface includes a first wall portion that extends outwardly from the inner wall surface and a second wall portion that extends transversely from the first wall portion to terminate at the distal end which is spaced apart from the inner wall surface by a second gap to provide the orifice.

3. The mixer assembly according to claim 2, including an inlet baffle with at least one inlet opening that directs exhaust gas flow into the exhaust gas inlet area between the inner wall surface and the flow directing surface.

4. The mixer assembly according to claim 3, wherein the injection member comprises a cone and wherein the exhaust gas inlet area is free from injected spray.

5. The mixer assembly according to claim 1, wherein the inner wall does not extend completely around the mixer center axis.

6. The mixer assembly according to claim 1, wherein the outer housing comprises a curved housing surface that surrounds the mixer center axis, and wherein the inner wall is spaced radially inwardly of the curved housing surface and extends at least partially about the mixer center axis.

7. The mixer assembly according to claim 6, including an inlet baffle supported by an upstream end of the outer housing, an outlet baffle supported by a downstream end of the outer housing, and wherein the injection member comprises a cone, and wherein the inlet baffle includes at least one first opening that directs exhaust gas into the exhaust gas inlet area and a second opening that directs exhaust gas into the injection inlet.

8. The mixer assembly according to claim 7, wherein the first opening overlaps the inlet exhaust gas area and receives a first percentage of the exhaust gas flow, and wherein the second opening receives a second percentage of the exhaust gas flow that is less than the first percentage.

9. The mixer assembly according to claim 8, wherein the inlet baffle includes at least one elongated scoop with a scoop opening that directs exhaust gas flow into the internal cavity, and wherein the inlet baffle includes a plurality of secondary openings that are smaller than the first and second openings.

10. The mixer assembly according to claim 7, wherein exhaust gas flow exiting the orifice is free from injected spray and subsequently mixes with the mixture of exhaust gas and spray exiting the injection outlet.

11. The mixer assembly according to claim 1, wherein the first gap comprises an insulating gap.

12. A vehicle exhaust component assembly comprising:

a mixer housing defining an internal cavity and surrounding a mixer center axis, wherein the mixer housing has a first inner wall surface; an inner wall that is spaced radially inward of the first inner wall surface of the mixer housing and extends at least partially about the mixer center axis, and wherein the inner wall provides a second inner wall surface that faces the mixer center axis;

an inlet baffle supported by an upstream end of the mixer housing, wherein the inlet baffle includes a plurality of inlet openings;

an outlet baffle supported by a downstream end of the mixer housing, wherein the outlet baffle includes at least one outlet opening;

an injection cone positioned between the inlet and outlet baffles, the injection cone having a cone inlet configured to receive injected fluid spray and a cone outlet to direct a mixture of injected fluid spray and exhaust gas into the internal cavity; and a flow diverter including a flow directing surface spaced apart from the second inner wall surface to provide an exhaust gas inlet area that receives exhaust gas from at least one of the inlet openings and which is free from injected fluid spray, and wherein the flow directing surface terminates at a distal end that is spaced apart from the second inner wall surface to provide an orifice between the distal end and the second inner wall surface that accelerates exhaust gas flow through the orifice and directs the exhaust gas flow to flow along the second inner wall surface to mix with the mixture of injected fluid spray and exhaust gas exiting the cone outlet, and wherein flow exiting the orifice is directed toward a surface opposite of the cone outlet.

13. The vehicle exhaust component assembly according to claim 12, wherein the mixer housing comprises an outer wall that includes the first inner wall surface and extends completely around the mixer center axis and wherein the inner wall is spaced radially inward of the first inner wall surface of the outer wall by an insulating gap and extends at least partially about the mixer center axis, and wherein the inner wall provides the second inner wall surface that faces the mixer center axis.

14. The vehicle exhaust component assembly according to claim 12, wherein the plurality of inlet openings includes at least a first inlet opening that directs a first portion of exhaust gas into the exhaust gas inlet area, a second opening that directs a second portion of exhaust gas toward the cone inlet, and a plurality of third openings that direct a remaining portion of the exhaust gas into the internal cavity, and wherein the first portion is greater than the second portion.

15. The vehicle exhaust component assembly according to claim 14, wherein the plurality of third openings includes at least one scoop opening, and wherein any other third openings are smaller than the first and second openings.

16. The vehicle exhaust component assembly according to claim 14 wherein the first and second openings are located adjacent an outer peripheral edge of the inlet baffle and are circumferentially spaced apart from each other.

17. The vehicle exhaust component assembly according to claim 12, wherein the inner wall is spaced radially inward of the first inner wall surface of the mixer housing by a first gap, and wherein the flow directing surface includes a first wall portion that extends outwardly from the second inner wall surface and a second wall portion that extends transversely from the first wall portion to terminate at the distal end which is spaced apart from the second inner wall surface by a second gap to define the orifice.

18. The vehicle exhaust component assembly according to claim 17, wherein the first and second wall portions cooperate to turn exhaust gas flow entering the exhaust gas inlet area at least ninety degrees prior to exiting the orifice.

19. The vehicle exhaust component assembly according to claim 12, wherein the inner wall does not extend completely about the mixer center axis.

20. A method for mixing an injected fluid spray and exhaust in a mixer comprising the steps of:

providing a mixer housing defining a mixer center axis and including an internal cavity that receives engine exhaust gases, and providing an inner wall positioned within the internal cavity and spaced radially inward of the mixer housing by a gap, the inner wall having an inner wall surface that faces the mixer center axis;

positioning an injection cone in the internal cavity;

injecting fluid spray into a cone inlet of the injection cone to mix with exhaust gas prior to exiting a cone outlet;

spacing a flow diverter with a flow directing surface apart from the inner wall surface to provide an exhaust gas inlet area;

positioning the flow directing surface to terminate at a distal end that is spaced apart from the inner wall surface to provide an orifice between the distal end and the inner wall surface; and accelerating exhaust gas flow through the orifice and directing the exhaust gas flow to flow along the inner wall surface to mix with injected fluid spray and exhaust gas exiting the cone outlet, and wherein flow exiting the orifice is directed toward a surface opposite of the cone outlet.

21. The method according to claim 20, wherein the exhaust gas inlet area is free from injected fluid spray.

22. The method according to claim 20, including using the flow diverter to turn exhaust gas flow entering the exhaust gas inlet area at least ninety degrees prior to exiting the orifice.

23. The method according to claim 20, wherein the flow directing surface includes a first wall portion that extends outwardly from the inner wall surface and a second wall portion that extends transversely from the first wall portion to terminate at the distal end which is spaced apart from the inner wall surface by a second gap to provide the orifice.

24. The method according to claim 23, wherein the gap between the mixer housing and the inner wall comprises an insulating gap.

25. The method according to claim 20, wherein the inner wall does not extend completely about the mixer center axis.

* * * * *